US006715836B1

(12) United States Patent
Chen et al.

(10) Patent No.: US 6,715,836 B1
(45) Date of Patent: Apr. 6, 2004

(54) ARMREST OF A CHAISE LONGUE

(76) Inventors: Yuan-Min Chen, P.O. Box 2-10, Tainan City (TW); Deng-Hae Liaw, P.O. Box 2-10, Tainan City (TW)

( * ) Notice: Subject to any disclaimer, the term of this patent is extended or adjusted under 35 U.S.C. 154(b) by 0 days.

(21) Appl. No.: 10/427,102

(22) Filed: Apr. 29, 2003

(51) Int. Cl.[7] ..... A47C 7/54
(52) U.S. Cl. ..... 297/411.39
(58) Field of Search ..... 297/411.39, 411.3, 297/411.32, 411.38

(56) References Cited

U.S. PATENT DOCUMENTS 4,118,069 A * 10/1978 Hunter ..... 297/411.29
4,400,033 A * 8/1983 Pietsch ..... 297/411.39
4,968,095 A * 11/1990 Moyer ..... 297/411.39
4,978,170 A * 12/1990 Pelz et al. ..... 297/411.39
5,316,373 A * 5/1994 Markel ..... 297/411.32
6,361,114 B1 * 3/2002 Rumler ..... 297/411.39

* cited by examiner

*Primary Examiner*—Peter R. Brown
(74) *Attorney, Agent, or Firm*—J.C. Patents

(57) ABSTRACT

An armrest of a chaise longue includes a seat, a backrest and two armrests. The backrest has its left and right side respectively provided with a shaft base. A shaft has one end inserted through the shaft base and received in an armrest shaft and the other end formed with an extending portion connected with a connecting rod. Thus, the armrest shaft enables the armrest to turn for a proper angle or maintain a horizontal position whenever the backrest is moved forward and backward.

2 Claims, 7 Drawing Sheets

ARMREST OF A CHAISE LONGUE

FIELD OF THE INVENTION

This invention relates to an armrest of a chaise tongue, particularly to one able to be adjusted freely in position or maintain a horizontal position whenever the backrest is moved forward and backward.

BACKGROUND OF THE INVENTION

A conventional chaise longue, as shown in FIG. 1, is composed of a seat 1, a backrest 10 and two armrests 11. The seat 1 and the backrest 10 are pivotally connected by a six-stage joint 12, which enables the backrest to be adjusted for various angles. A fixing shaft 13 is provided between the armrest 11 and the backrest 10, letting the armrest able to move forward or backward only.

However, such a conventional chaise longue may cause trouble when it is used. For instance, to make a chaise longue level to be used as a bed, a user has to manually collapse the two armrests 1 to the opposite sides of the backrest.

SUMMARY OF THE INVENTION

The objective of the invention is to offer the armrest of a chaise longue, able to be turned freely in various directions or kept in a horizontal position whenever the backrest is adjusted in position.

The features of the invention are as follows.

1. The chaise longue is composed of a seat, a backrest and two armrests. The two armrests are respectively combined with the backrest by an armrest shaft provided on each armrest, and the two armrest shafts enable the two armrests to be adjusted for an angle larger or smaller than 90 degrees.

2. The backrest of the chaise longue is provided on the opposite sides with a shaft base inserted therethrough with a shaft, which is then inserted in the armrest shaft. The shaft has one end formed with a vertical extending portion connected with the upper end of a connecting rod which has its lower end connected with the rod of the seat. Thus, the two armrests can maintain a horizontal position whenever the backrest is adjusted for a certain angle.

BRIEF DESCRIPTION OF DRAWINGS

This invention will be better understood by referring to the accompanying drawings, wherein.

DETAILED DESCRIPTION OF THE INVENTION

Figure 1:
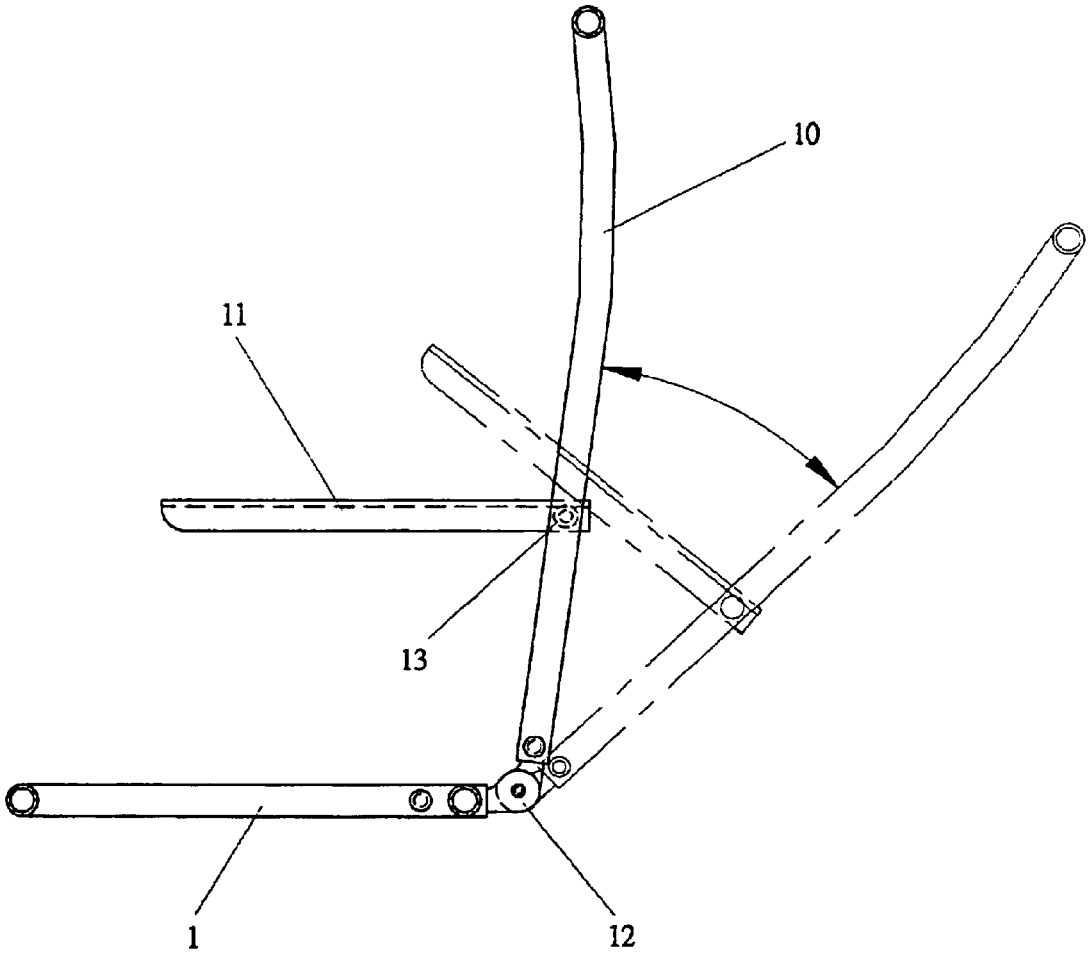
FIG 1 (PRIOR ART)
FIG. 1 is a side view of a conventional chaise longue in an operating condition.
Figure 2:
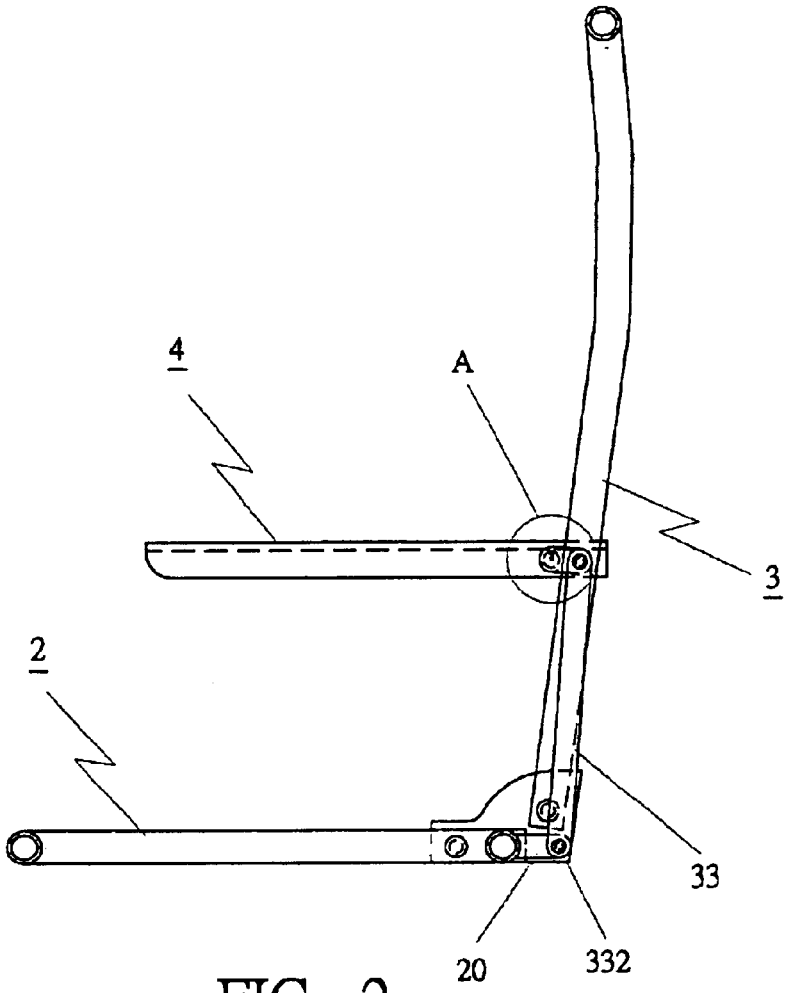
FIG. 2 is a side sectional view of a first preferred embodiment of a chaise longue in the present invention.

A first preferred embodiment of a chaise longue in the present invention, as shown in FIGS. 2–9, includes a seat 2, a backrest 3 and two armrests 4 combined together.

The seat 2 has two rods 20 respectively provided under the opposite rear sides, with each rod 20 having a lateral hole 200.

Figure 8:
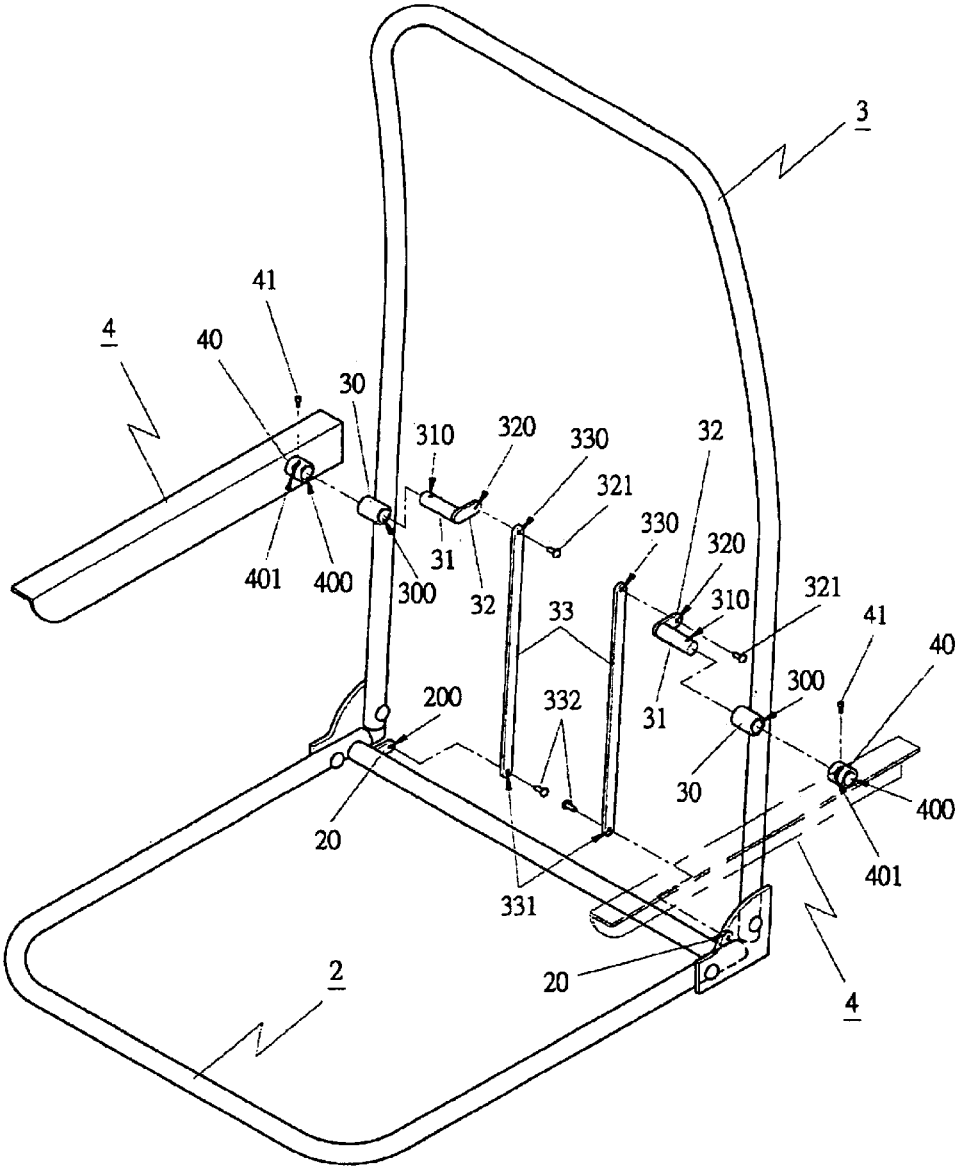
FIG. 8 is an exploded perspective view of the first preferred embodiment of the chaise longue in the present invention.
Figure 9:
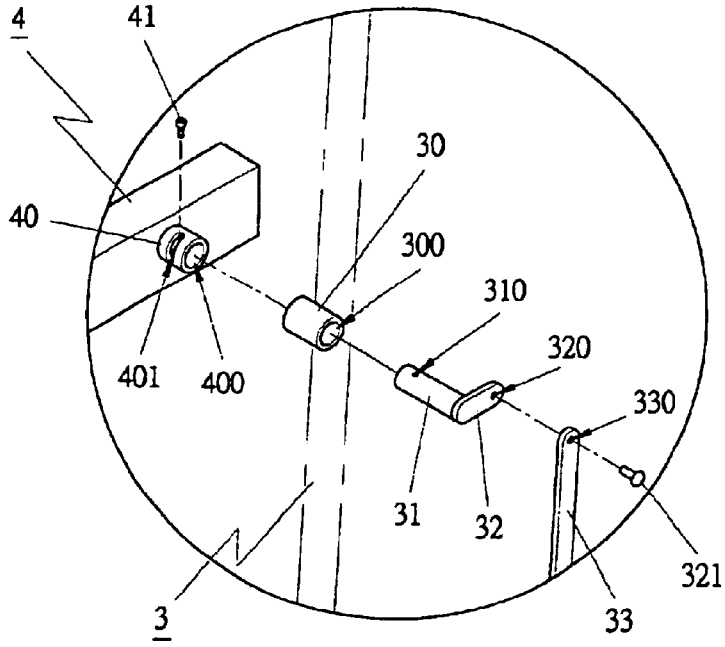
FIG. 9 is partial magnified view of the first preferred embodiment of the chaise longue in the present invention.

The backrest 3 is provided on the opposite sides with a shaft base 30 having an axial hole 300 for a shaft 31 to be inserted therethrough. Each shaft 31 is bored with a vertical hole 310 and has one end formed with a vertical extending portion 32 having a through hole 320, as shown in FIGS. 8 and 9, with the two extending portions 32 respectively connected with two connecting rods 33. Each connecting rod 33 has its upper and lower end respectively bored with a lateral hole 330, 331, with a support shaft 321 inserted through the through hole 320 of the extending portion 32 and the lateral hole 330 of the connecting rod 33. Each connecting rod 33 has its lower end connected with the rod 20 of the seat 2 by a support shaft 332 inserted through the lateral hole 331 of the connecting rod 33 and the lateral hole 200 of the rod 20 of the seat 2.

Figure 3:
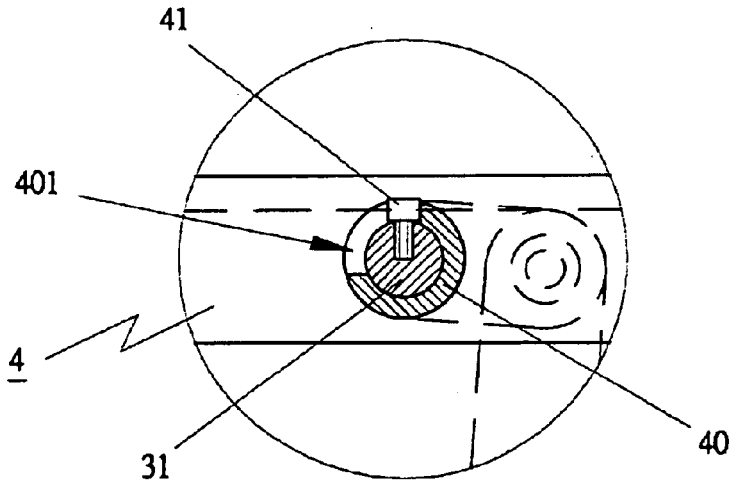
FIG. 3 is a partial magnified cross-sectional view of the portion marked with A in FIG. 3.
Figure 4:
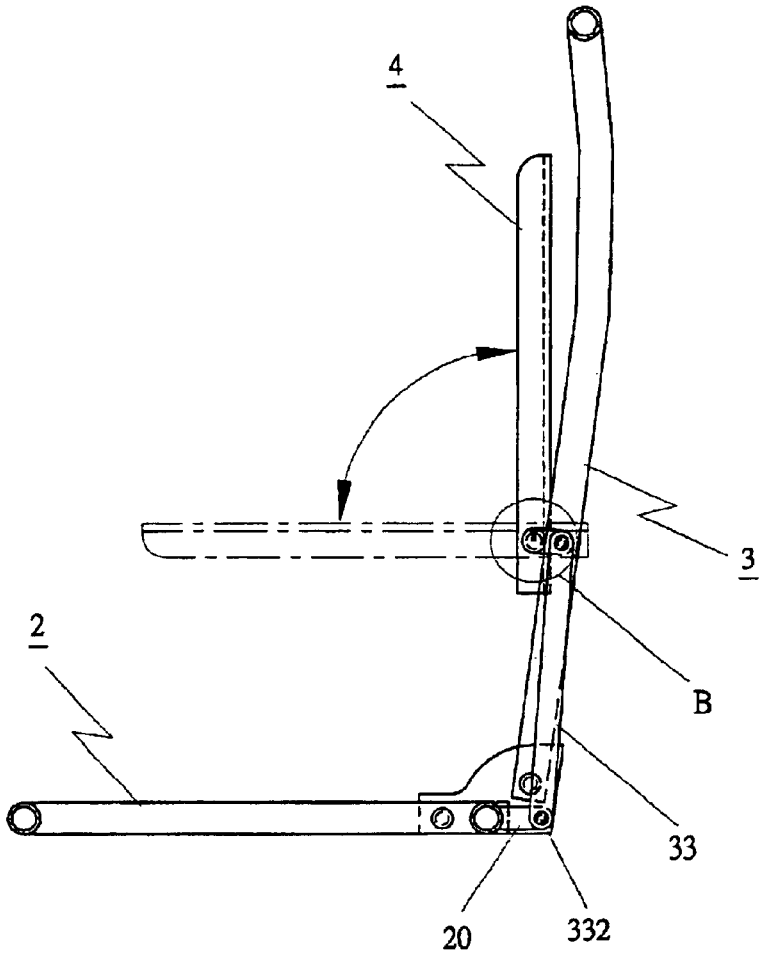
FIG. 4 is a side sectional view of the first preferred embodiment of the chaise longue in an operating condition in the present invention.
Figure 5:
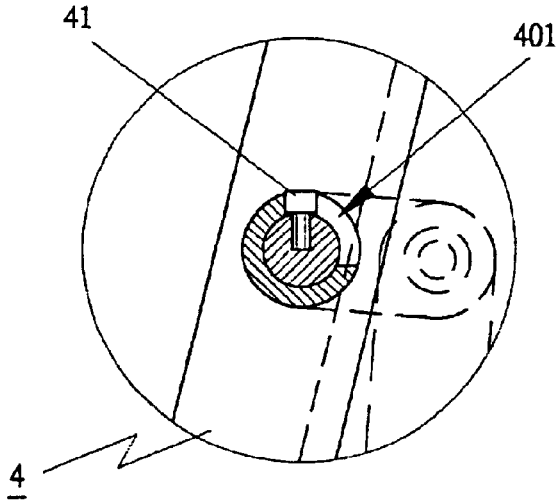
FIG. 5 is a partial magnified cross-sectional view of the portion marked with B in FIG. 4.
Figure 6:
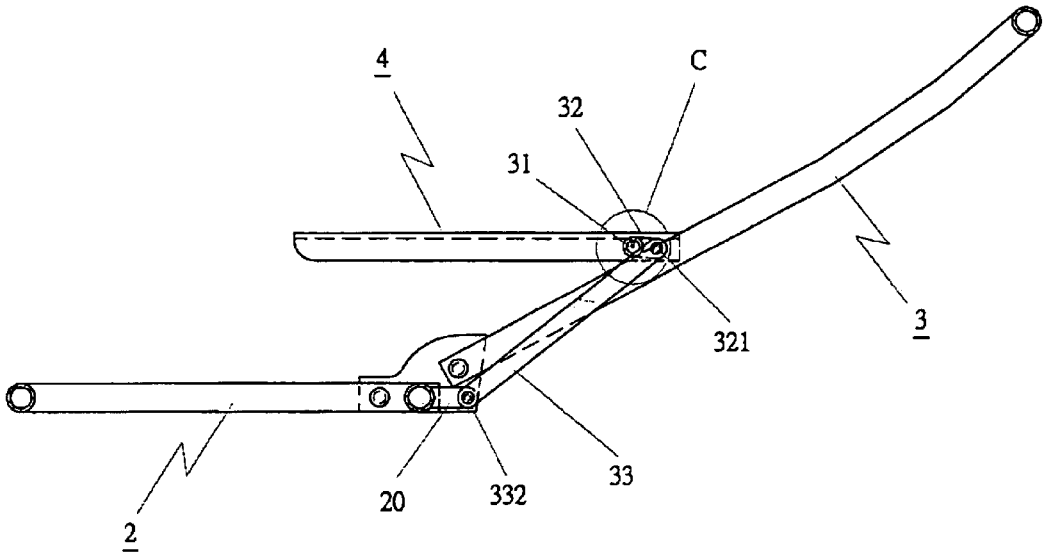
FIG. 6 is side sectional view of the first preferred embodiment of the chaise longue in another operating condition in the present invention.
Figure 7:
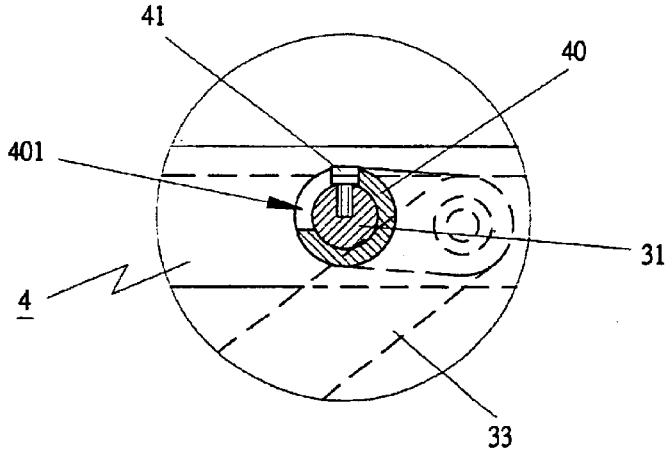
FIG. 7 is a partial magnified cross-sectional view of the portion marked with C in FIG. 6.

The two armrests 4 are respectively provided with an armrest shaft 40 having axial hole 400 for receiving the shaft 31. The armrest shaft 40 is bored with a long slot 401, and a bolt 4.1 is inserted through the long slot 401 and the vertical hole 310 of the shaft 31, as shown in FIGS. 3, 5 and 7. Thus, the armrest 4 can be positioned horizontally or collapsed backward to an angle larger than 90 degrees by making use of the long slot 401, as shown in FIG. 4. By so designing, the armrests 4 can maintain a horizontal position by means of the long slot 401 when the backrest 3 is adjusted to different angles.

Figure 10:
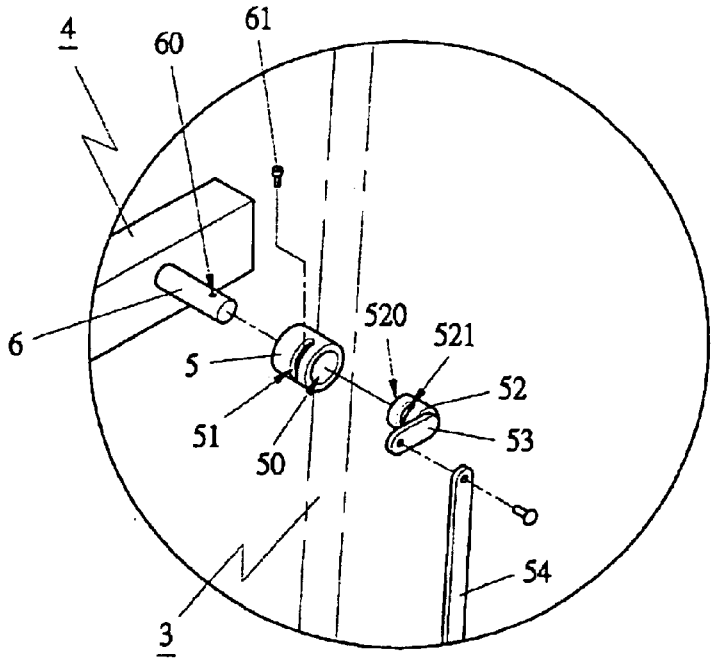
FIG. 10 is a partial magnified view of a second preferred embodiment of the chaise longue in the present invention.

A second preferred embodiment of the chaise longue in the present invention, as shown in FIG. 10, is to have a shaft base 5 provided on the left and the right side of the backrest 3. Each shaft base 5 is provided with an axial hole 50, a long slot 51 and an outer shaft 52. The outer shaft 52 is bored with an axial groove 520 and a long slot 521, and has one end formed with a vertical extending portion 53 connected with a connecting rod 54. Each armrest 4 is provided with an inner shaft 6 having a vertical hole 60 and inserted through the axial hole 50 of the shaft base 5 and positioned in the axial groove 520 of the outer shaft 52. Then, a bolt 61 is inserted through the two long slots 51, 521 and received in the vertical hole 60 of the inner shaft 6, thus having the same effect as that described in the first preferred embodiment.

Figure 11:
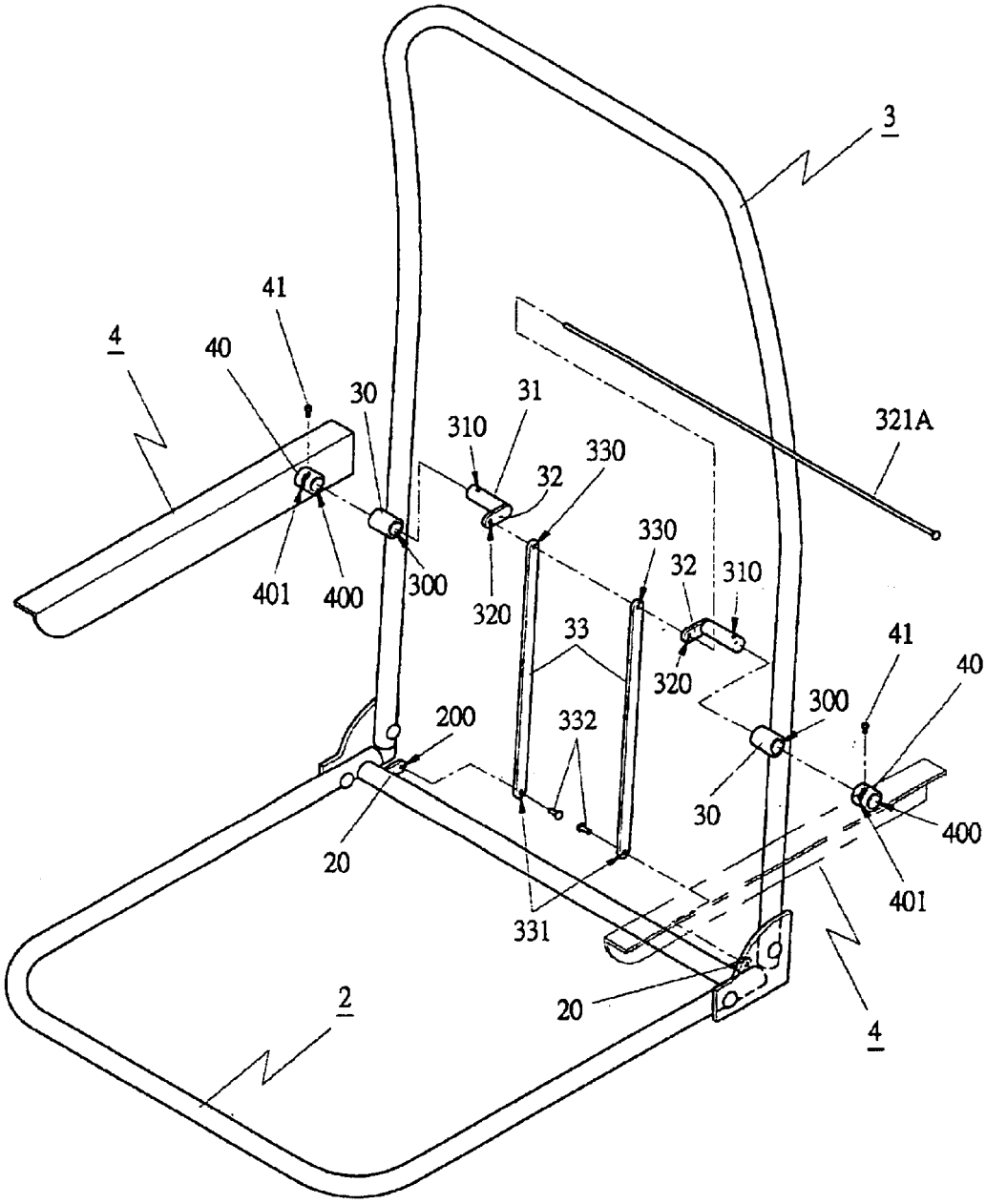
FIG. 11 is an exploded perspective view of a third preferred embodiment of the chaise longue in the present invention.

Further, FIG. 11 shows a third embodiment of the invention, modified from the first embodiment shown in FIG. 8, including a backrest 3 provided with a shaft base 30 bored with an axial hole 300 for a shaft 31 to fit through. The shaft 31 has a straight hole 310, and a extending portion 32 facing inward on a side and different from the vertical extending portion 32 facing outward in the first embodiment. The extending portion 32 has a hole 320 and connected with a connecting rod 33 by a shaft 321A extending through the hole 320 and a hole 330 of the connecting rod 33. The lower portion of the connecting rod 33 has a hole 331 for a shaft 332 to extend in and also in a hole 200 of the rod 20 to stabilize the two connecting rods 33 with the two lower ends of the backrest 3.

The two armrests 4 in the third embodiment are all the same as those in the first embodiment, permitting the third embodiment have the same function as the first embodiment.

While the preferred embodiments of the invention have been described above, it will be recognized and understood that various modifications may be made therein and the appended claims are intended to cover all such modifications that may fall within the spirit and scope of the invention.

What is claim is:

1. A chaise longue comprising:

a seat provided with a rod under opposite rear sides thereof, said rod having a lateral hole;

a backrest provided with a shaft base at a left side and a right side thereof, a backrest shaft inserted through said shaft base and having a vertical hole, said backrest shaft having one end formed with an extending portion, said extending portion pivotally connected with an upper end of a connecting rod, said connecting rod having its lower end connected with said rod of said seat through said lateral hole;

two armrests respectively provided with an armrest shaft, said armrest shaft having an axial hole for receiving said backrest shaft, said armrest shaft bored with a long slot extending along an outer periphery thereof, a bolt inserted through said long slot and received in said vertical hole of said backrest shaft;

wherein said bolt is engaged with said long slot so as to restrict rotational movement of said armrest around an axis of said backrest shaft, enabling said armrests to maintain a horizontal position or be moved backward to an angle larger than 90 degree and collapsed, and due to the engagement of said connecting rod with said rod of said seat and said extending portion of said backrest shaft, said armrests are able to keep a horizontal position when said backrest is adjusted to different angles.

2. A chaise longue comprising:

a seat provided with a rod under opposite rear sides thereof, said rod having a lateral hole;

a backrest provided with a shaft base at a left side and a right side thereof, said shaft base bored with an axial hole and a first long slot extending along an outer periphery thereof, said shaft base further provided with an outer shaft, said outer shaft formed with an axial groove and a second long slot extending along an outer periphery thereof, said outer shaft having one end formed with an extending portion, said extending portion connected with a connecting rod, said connecting rod having its lower end connected with said rod of said seat through said lateral hole;

two armrests respectively provided with an inner shaft having a vertical hole, said inner shaft inserted through said axial hole of said shaft base of said backrest and received in said axial groove of said outer shaft, a bolt inserted through said first and second long slots and received in said vertical hole of said inner shaft of said armrest;

wherein said bolt is engaged with said first and second long slots to restrict rotational movement of said armrest around an axis of said backrest shaft, enabling said armrests to keep level or be moved backward to an angle larger than 90 degree and collapsed, and due to the engagement of said connecting rod with said rod of said extending portion of said extending portion of said outer shaft, said armrests are able to maintain a horizontal position when said backrest is adjusted to different angles.

* * * * *